US007291239B2

(12) United States Patent
Polanco et al.

(10) Patent No.: US 7,291,239 B2
(45) **Date of Patent: *Nov. 6, 2007**

(54) HIGH LOFT LOW DENSITY NONWOVEN WEBS OF CRIMPED FILAMENTS AND METHODS OF MAKING SAME

(75) Inventors: Braulio A. Polanco, Canton, GA (US); Christopher Dale Fenwick, Alpharetta, GA (US); Darryl Franklin Clark, Hendersonville, NC (US); Bryan David Haynes, Cumming, GA (US); Kurtis Lee Brown, Alpharetta, GA (US); Chad Michael Freese, Atlanta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 301 days.

This patent is subject to a terminal disclaimer.

(21) Appl. No.: 10/938,294

(22) Filed: Sep. 10, 2004

(65) Prior Publication Data

US 2005/0098256 A1 May 12, 2005

Related U.S. Application Data

(62) Division of application No. 10/037,467, filed on Dec. 21, 2001, now abandoned.

(51) Int. Cl.
*D04H 3/08* (2006.01)
*D01D 5/22* (2006.01)

(52) U.S. Cl. ..... 156/161; 156/181; 156/244.11; 264/168; 264/211.14

(58) Field of Classification Search ..... 156/161, 156/181, 244.1; 264/168, 511.14
See application file for complete search history.

(56) References Cited

U.S. PATENT DOCUMENTS

| | | | | |
|---|---|---|---|---|
| 3,507,943 | A | 4/1970 | Such et al. | |
| 3,623,939 | A * | 11/1971 | Ono et al. | 428/369 |
| 3,855,046 | A | 12/1974 | Hansen et al. | |
| D239,566 | S | 4/1976 | Vogt | |
| 4,217,321 | A | 8/1980 | Campbell | |
| D264,512 | S | 5/1982 | Rogers | |
| 4,374,888 | A | 2/1983 | Bornslaeger | |
| 4,493,868 | A | 1/1985 | Meitner | |
| 4,590,114 | A | 5/1986 | Holtman | |

(Continued)

FOREIGN PATENT DOCUMENTS

EP 0 152 883 A2 8/1985

(Continued)

*Primary Examiner*—Richard Crispino
*Assistant Examiner*—Michael A Tolin
(74) *Attorney, Agent, or Firm*—Pauley Petersen & Erickson

(57) ABSTRACT

High loft, low density nonwoven webs are produced by forming substantially continuous, spunbond, crimped, bicomponent fibers of A/B bilateral morphology in an unheated fiber draw unit. The fibers are then heated and cooled in the absence of impeding forces to achieve maximum crimp in the z-direction and produce a web of lofted material. The resultant material is particularly suitable for use as an insulator. Particulates may be added to the webs if desired.

24 Claims, 3 Drawing Sheets

U.S. PATENT DOCUMENTS 4,663,220 A 5/1987 Wisneski et al.
4,692,106 A 9/1987 Grabowski et al.
4,704,116 A 11/1987 Enloe
4,795,668 A 1/1989 Krueger et al.
4,798,603 A 1/1989 Meyer et al.
4,820,459 A 4/1989 Reifenhauser
4,837,067 A 6/1989 Carey, Jr. et al.
4,851,179 A 7/1989 Reifenhauser
4,985,304 A 1/1991 Wang
5,108,820 A 4/1992 Kaneko et al.
5,176,668 A 1/1993 Bernardin
5,176,672 A 1/1993 Bruemmer et al.
5,192,606 A 3/1993 Proxmire et al.
5,226,992 A 7/1993 Morman
5,302,220 A * 4/1994 Terakawa et al. ..... 156/167
5,336,552 A 8/1994 Strack et al.
5,382,400 A 1/1995 Pike et al.
5,385,775 A * 1/1995 Wright ..... 442/183
5,399,219 A 3/1995 Roessler et al.
5,418,045 A 5/1995 Pike et al.
5,427,845 A 6/1995 Sawyer et al.
5,486,166 A 1/1996 Bishop et al.
5,490,846 A 2/1996 Ellis et al.
5,509,915 A 4/1996 Hanson et al.
5,522,810 A 6/1996 Allen, Jr. et al.
5,527,600 A 6/1996 Frankosky et al.
5,540,796 A 7/1996 Fries
5,571,537 A 11/1996 Geus et al.
5,593,768 A 1/1997 Gessner
5,595,618 A 1/1997 Fries et al.
5,622,772 A 4/1997 Stokes et al.
5,672,415 A 9/1997 Sawyer et al.
5,679,042 A * 10/1997 Varona ..... 442/347
5,707,468 A 1/1998 Arnold et al.
5,711,970 A 1/1998 Lau et al.
5,766,646 A 6/1998 Geus et al.
5,773,120 A 6/1998 Deka et al.
5,814,349 A 9/1998 Geus et al.
5,858,515 A 1/1999 Stokes et al.
5,874,159 A 2/1999 Cruise et al.
5,904,971 A 5/1999 Anderson et al.
5,916,678 A 6/1999 Jackson et al.
5,993,714 A 11/1999 Sawyer et al.
6,024,813 A * 2/2000 Groeger et al. ..... 156/62.8
6,066,221 A 5/2000 Marmon et al.
6,074,869 A 6/2000 Pall et al.
6,080,482 A 6/2000 Martin et al.
6,168,849 B1 1/2001 Braverman et al.
6,176,955 B1 1/2001 Haynes et al.
6,203,889 B1 3/2001 Quincy, III et al.
6,218,009 B1 4/2001 Tsai et al.
6,261,677 B1 7/2001 Tsai et al.
6,436,328 B1 8/2002 DiPalma
6,454,989 B1 9/2002 Neely et al.
6,588,080 B1 7/2003 Neely et al.
6,635,136 B2 10/2003 White et al.
6,992,028 B2 1/2006 Thomaschefsky et al.
2002/0074697 A1 6/2002 Steinke et al.
2003/0118816 A1 * 6/2003 Polanco et al. ..... 428/369
2003/0129908 A1 7/2003 Wadsworth et al.
2004/0077247 A1 4/2004 Schmidt et al.

FOREIGN PATENT DOCUMENTS

EP 0 217 032 4/1987
EP 0 586 924 A1 3/1994
EP 0 683 260 A2 11/1995
WO WO 93/02610 2/1993
WO 95/16425 6/1995
WO WO 98/01607 1/1998
WO WO 99/16946 4/1999
WO WO 99/32706 7/1999
WO WO 00/66057 11/2000
WO WO 01/11119 A1 2/2001
WO WO 01/74281 A1 10/2001
WO WO 02/057525 A2 7/2002

* cited by examiner

HEATED FDU
Tight Helical Crimp

Ambient FDU
Macroscopic Crimp

HIGH LOFT LOW DENSITY NONWOVEN WEBS OF CRIMPED FILAMENTS AND METHODS OF MAKING SAME

This application is a divisional application of application Ser. No. 10/037,467, filed 21 Dec. 2001 now abandoned, and claims priority therefrom. Application Ser. No. 10/037,467 is incorporated by reference in its entirety.

BACKGROUND OF THE INVENTION

This invention relates to a high loft, low density nonwoven material produced from continuous fibers in which the lofty character of the nonwoven material is the result of the fibers comprising the web having a z-direction orientation, resulting from improved processing and the resultant crimping. These materials are particularly suitable for use in a broad range of applications including, without limitation, surge layers for personal care products, acoustic and thermal insulation, packing material, padding, absorbents, filtering, and cleaning materials.

DISCUSSION OF THE RELATED ART

In nonwoven webs, the fibers comprising the web are generally oriented in the x-y plane of the web and the resulting nonwoven web material is relatively thin, that is lacking in loft or significant thickness.

Loft or thickness in a nonwoven web suitable for use in personal care absorbent articles promotes comfort (softness) to the user, surge management and fluid distribution to adjacent layers. In order to impart loft or thickness to a nonwoven web, it is generally desirable that at least a portion of the fibers comprising the web be oriented in the z-direction. Conventionally, lofty nonwoven webs are produced using staple fibers. See, for example, U.S. Pat. No. 4,837,067 which teaches a nonwoven thermal insulating batt comprising structural staple fibers and bonding staple fibers which are entangled and substantially parallel to the faces of the batt at the face portions and substantially perpendicular to the faces of the batt, and U.S. Pat. No. 4,590,114 which teaches a batt including a major percent of thermo-mechanical wood pulp fibers stabilized by the inclusion of a minor percent of thermoplastic fibers including staple length thermoplastic fibers. Alternatively, conventional high loft forming processes rely on pre-forming processes such as fiber crimp formed on a flat wire or drum, and post-forming processes such as creping or pleating of the formed web.

Others in the art have sought to provide lofty materials by first forming a standard nonwoven web, and then pleating or corrugating that web by folding the web upon itself. However, in such constructions the fibers of the web still remain in the plane of the web, it is only the plane of the web itself which has been distorted.

Inventions related hereto by the fact that the fibers have true z-direction orientation outside of the plane of the web, such as U.S. patent application Ser. Nos. 09/538,744 and 09/559,155, may generally be characterized as forming a lofty material which has folds induced in the base material fibers, producing z-direction fibers through the use of a transfer process between differential speed forming wires.

However, there exists a need in the art for alternative high loft, low density fabrics which may exhibit a good balance of fluid control having fast intake, low flow back and high horizontal distribution, as well as good web morphology, and the other above-mentioned properties including insulation, padding, and the like.

SUMMARY OF THE INVENTION

In response to the above-described needs in the art, the present invention utilizes the natural crimping ability of certain bicomponent, substantially continuous, thermoplastic fibers of A/B morphology, i.e., a bilateral configuration, generally side by side or eccentric sheath/core construction, to produce high loft, low density nonwoven webs. While this class of fiber types is known in the art, per se, special processing parameters are applied by the present invention to derive precursor filaments suitable for processing into high loft, low density fabrics. The fibers are then crimped into high loft, low density fabrics by novel techniques applied after filament formation. Additionally, new techniques were developed to ensure the stability of the resultant high loft, low density fabrics after the filaments have been crimped.

In one aspect of the invention, the new fabrics may comprise a high loft, low density nonwoven web having a web of substantially continuous, spunbond, helically crimped, bicomponent fibers of A/B morphology. Within the web the fibers are randomly crimped to produce a lofted material with heterogeneous, random, fiber orientation, including heterogeneous z-direction orientation to produce loft of the web, and irregularly spaced openings between the crimped fibers. By way of illustration lofty webs of the present invention may have a basis weight from about 0.3 osy to 25 osy exhibiting densities from about 0.002 g/cc to 0.05 g/cc and lofts from 0.02" to 1.5". For example, a 0.5 osy web may exhibit loft from about 0.03" to 0.3" at a density range of 0.022 to 0.002 g/cc. As another example, 3.0 osy web may exhibit loft from 0.1" to 1.5" at a density range of 0.04 to 0.003 g/cc.

In another aspect the new fabrics may comprise a high loft, low density nonwoven web made from highly machine direction oriented substantially continuous, spunbond, helically crimped, bicomponent fibers of A/B morphology. Within the web the fibers are randomly crimped to produce a lofted material with a very high loft by inducing shingled layers with a buckled z-direction orientation to produce loft of the web, and irregularly spaced openings between the crimped fibers.

The methodology for making high loft, low density nonwoven webs according to the present invention may include initially producing the bicomponent filaments with an unheated fiber draw unit (FDU) rather than using the heated FDUs prevalent in the art. The fibers are then collected on the forming wire and heated to relax the polymer chains and initiate crimping. Immediately after this heating the web is cooled so that the fibers do not bond, thereby maintaining the mobility of the fibers and allowing the fibers to crimp to the desired extent. Other processing parameters such as wire vacuum may be controlled to further allow the fibers to crimp unimpeded. Upon crimping, a high loft, low density fabric is created. Additional heating is then applied to set the web. Processing parameters can be controlled in the final heating phase to maintain the web in the original high loft, low density state or the parameters may be controlled to adjust the density and loft of the web during this phase.

BRIEF DESCRIPTION OF THE DRAWINGS

These and other objects and features of this invention will be better understood from the following detailed description taken in conjunction with the drawings wherein.

DEFINITIONS

Figure 1:
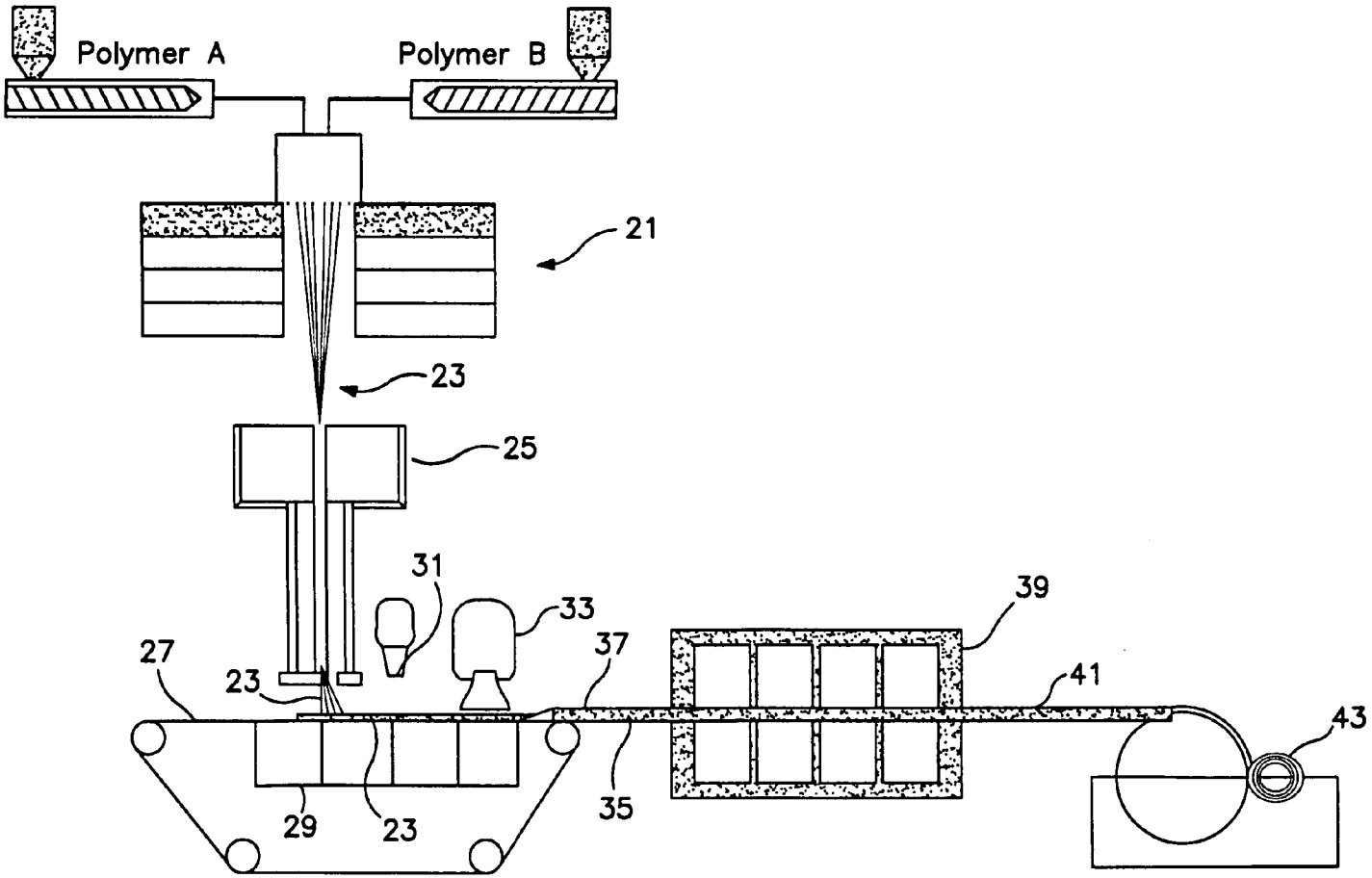
FIG. 1 illustrates a process and apparatus for producing a lofty, nonwoven material in accordance with one embodiment of this invention.

As used herein, the term "nonwoven web" or "nonwoven material" means a web having a structure of individual fibers, filaments or threads which are interlaid, but not in a regular or identifiable manner such as those in a knitted fabric or films that have been fibrillated. Nonwoven webs or materials have been formed from many processes such as, for example, meltblowing processes, spunbonding processes, and bonded carded web processes. The basis weight of nonwoven webs or materials is usually expressed in ounces of material per square yard (osy) or grams per square meter (gsm), and the fiber diameters are usually expressed in microns. (Note that to convert from osy to gsm, multiply osy by 33.91.)

As used herein, the term "z-direction" refers to fibers disposed outside of the plane of orientation of a web. A web will be considered to have an x-axis in the machine direction, a y-axis in the cross machine direction and a z-axis in the loft direction, with its major planes, or surfaces, lying parallel with the x-y plane. The term "as formed z-direction fibers" may be used herein to refer to fibers that become oriented in the z-direction during forming of the nonwoven web as distinguished from fibers having a z-direction component resulting from post-forming processing of the nonwoven web, such as in the case of mechanically crimped or creped or otherwise disrupted nonwoven webs.

As used herein, the term "substantially continuous fibers" refers to fibers which are not cut from their original length prior to being formed into a nonwoven web or fabric. Substantially continuous fibers may have average lengths ranging from greater than about 15 centimeters to more than one meter, and up to the length of the web or fabric being formed. The definition of "substantially continuous fibers" includes fibers which are not cut prior to being formed into a nonwoven web or fabric, but which are later cut when the nonwoven web or fabric is cut, and fibers which are substantially linear or crimped.

As used herein, the term "through-air bonding" or "TAB" means the process of bonding a nonwoven, for example a bicomponent fiber web, in which air which is sufficiently hot to melt one of the polymers of which the fibers of the web are made is forced through the web.

As used herein "side by side fibers" belong to the class of bicomponent or conjugate fibers. The term "bicomponent fibers" refers to fibers which have been formed from at least two polymers extruded from separate extruders but spun together to form one fiber. Bicomponent fibers are also sometimes referred to as conjugate fibers or multicomponent fibers. Bicomponent fibers are taught, e.g., by U.S. Pat. No. 5,382,400 to Pike et al. The polymers of conjugate fibers are usually different from each other though some conjugate fibers may be monocomponent fibers. Conjugate fibers are taught in U.S. Pat. No. 5,108,820 to Kaneko et al., U.S. Pat. No. 4,795,668 to Krueger et al. and U.S. Pat. No. 5,336,552 to Strack et al. Conjugate fibers maybe used to produce crimp in the fibers by using the differential rates of expansion and contraction of the two (or more) polymers.

"Low machine direction orientation" and "high machine direction orientation" as used herein refers to the degree to which the fibers of a nonwoven web are allowed to disperse over the cross direction of the forming surface, e.g. a foraminous wire. Low machine direction orientation fibers are dispersed across the cross direction to a higher degree than a collection of fibers exhibiting a higher machine direction orientation which have less dispersion over the cross direction of the forming surface during the formation of a web.

Words of degree, such as "about", "substantially", and the like are used herein in the sense of "at, or nearly at, when given the manufacturing and material tolerances inherent in the stated circumstances" and are used to prevent the unscrupulous infringer from unfairly taking advantage of the invention disclosure where exact or absolute figures are stated as an aid to understanding the invention.

As used herein, the term "machine direction" or MD means the length of a fabric in the direction in which it is produced. The term "cross machine direction" or CD means the width of fabric, i.e. a direction generally perpendicular to the MD.

"Particle," "particles," "particulate," "particulates" and the like, refer to a material that is generally in the form of discrete units. The particles can include granules, pulverulents, powders or spheres. Thus, the particles can have any desired shape such as, for example, cubic, rod-like, polyhedral, spherical or semi-spherical, rounded or semi-rounded, angular, irregular, etc. Shapes having a large greatest dimension/smallest dimension ratio, like needles, flakes and fibers, are also contemplated for use herein. The use of "particle" or "particulate" may also describe an agglomeration including more than one particle, particulate or the like.

DESCRIPTION OF PREFERRED EMBODIMENTS

FIG. 1 is a schematic diagram illustrating methods and apparatus of this invention for producing high loft, low density materials by producing crimpable bicomponent substantially continuous fibers of A/B morphology, i.e., a bilateral configuration, generally side by side or eccentric sheath/core, and causing them to crimp in an unrestrained environment.

As shown in FIG. 1, two polymers A and B are spunbond with known thermoplastic fiber spinning apparatus 21 to form bicomponent, or A/B, morphology fibers 23. The fibers 23 are then traversed through a fiber draw unit (FDU) 25. According to one embodiment of the present invention, unlike the standard practice in the art, the FDU is not heated, but is left at ambient temperature. The fibers 23 are left in a substantially continuous state and are deposited on a moving forming wire 27. Deposition of the fibers is aided by an under-wire vacuum supplied by a negative air pressure unit, or below wire exhaust, 29.

The fibers 23 are then heated by traversal under one of a hot air knife (HAK) 31 or hot air diffuser 33, which are both shown in the figure but will be appreciated to be used in the alternative under normal circumstances. A conventional hot air knife includes a mandrel with a slot that blows a jet of hot air onto the nonwoven web surface. Such hot air knives are taught, for example, by U.S. Pat. No. 5,707,468 to Arnold, et al. The hot air diffuser 33 is an alternative which operates in a similar manner but with lower air velocity over a greater surface area and thus uses correspondingly lower air temperatures. The group, or layer, of fibers may receive an external skin melting or a small degree of nonfunctional bonding during this traversal through the first heating zone. "Nonfunctionally bonded" is a bonding sufficient only to hold the fibers in place for processing according to the method herein but so light as to not hold the fibers together were they to be manipulated manually. Such bonding may be incidental or eliminated altogether if desirable.

The fibers are then passed out of the first heating zone of the hot air knife 31 or hot air diffuser 33 to a second wire 35 where the fibers continue to cool and where the below wire exhaust 29 is removed so as to not disrupt crimping. As the fibers cool they will crimp in the z-direction, or out of the plane of the web, and form a high loft, low density nonwoven web 37. The web 37 is then transported to a through air bonding (TAB) unit 39 to set, or fix, the web at a desired degree of loft and density. Alternatively, the through air bonding (TAB) unit 39 can be zoned to provide a first heating zone in place of the hot air knife 31 or hot air diffuser 33, followed by a cooling zone, which is in turn followed by a second heating zone sufficient to fix the web. The fixed web 41 can then be collected on a winding roll 43 or the like for later use.

In accordance with one preferred embodiment of this invention, the substantially continuous fibers are bicomponent fibers. Webs of the present invention may contain a single denier structure (i.e., one fiber size) or a mixed denier structure (i.e., a plurality of fiber sizes). Particularly suitable polymers for forming the structural component of suitable bicomponent fibers include polypropylene and copolymers of polypropylene and ethylene, and particularly suitable polymers for the adhesive component of the bicomponent fibers includes polyethylene, more particularly linear low density polyethylene, and high density polyethylene. In addition, the adhesive component may contain additives for enhancing the crimpability and/or lowering the bonding temperature of the fibers, as well as enhancing the abrasion resistance, strength and softness of the resulting webs. A particularly suitable bicomponent polyethylene/polypropylene fiber for processing according to the present invention is known as PRISM. A description of PRISM is disclosed in U.S. Pat. No. 5,336,552 to Strack et al. Webs made according to the present invention may further contain fibers having resins alternative to PP/PE, such as, without limitation: PET, Copoly-PP+3% PE, PLA, PTT, Nylon, PBT, etc. Fibers may be of various alternative shapes and symmetries including Pentaloble, Tri-T, Hollow, Ribbon, X, Y, H, and asymmetric cross sections.

Polymers useful in the manufacture of the system materials of the invention may further include thermoplastic polymers like polyolefins, polyesters and polyamides. Elastic polymers may also be used and include block copolymers such as polyurethanes, copolyether esters, polyamide polyether block copolymers, ethylene vinyl acetates (EVA), block copolymers having the general formula A-B-A' or A-B like copoly(styrene/ethylene-butylene), styrene-poly(ethylene-propylene)-styrene, styrene-poly(ethylene-butylene)-styrene, (polystyrene/poly(ethylene-butylene)/polystyrene, poly(styrene/ethylene-butylene/styrene) and the like.

Polyolefins using single site catalysts, sometimes referred to as metallocene catalysts, may also be used. Many polyolefins are available for fiber production, for example polyethylenes such as Dow Chemical's ASPUN7 6811A linear low density polyethylene, 2553 LLDPE and 25355 and 12350 high density polyethylene are such suitable polymers. The polyethylenes have melt flow rates, respectively, of about 26, 40, 25 and 12. Fiber forming polypropylenes include Exxon Chemical Company's 3155 polypropylene and Montell Chemical Co.'s PF-304. Many other polyolefins are commercially available.

Biodegradable polymers are also available for fiber production and suitable polymers include polylactic acid (PLA) and a blend of BIONOLLE, adipic acid and UNITHOX (BAU). PLA is not a blend but a pure polymer like polypropylene. BAU represents a blend of BIONOLLE, adipic acid, and UNITHOX at different percentages. Typically, the blend for staple fiber is 44.1 percent BIONOLLE 1020, 44.1 percent BIONOLLE 3020, 9.8 percent adipic acid and 2 percent UNITHOX 480, though spunbond BAU fibers typically use about 15 percent adipic acid. BIONOLLE 1020 is polybutylene succinate, BIONOLLE 3020 is polybutylene succinate adipate copolymer, and UNITHOX 480 is an ethoxylated alcohol. BIONOLLE is a trademark of Showa Highpolymer Co. of Japan. UNITHOX is a trademark of Baker Petrolite which is a subsidiary of Baker Hughes International. It should be noted that these biodegradable polymers are hydrophilic and so are preferably not used for the surface of the inventive intake system materials.

Per the above, the crimpable bicomponent fiber is heated by the HAK 31, hot air diffuser 33 or zoned TAB (not shown) in the first heating zone to a temperature where the polyethylene crystalline regions start to relax their oriented molecular chains and may begin melting. Typical air temperature used to induce crimp have ranged from about 110-260 degrees F. This temperature range represents temperatures of submelting degree which merely relax the molecular chain up through melting temperatures for the polymers. The heat of the air stream from the HAK 31 may be made higher due to the short dwell time of the fibers through its narrow heating zone. Further, when heat is applied to the oriented molecular chains of the fibers, the molecular chain mobility increases. Rather that being oriented, the chains prefer to relax in a random state. Therefore, the chains bend and fold causing additional shrinkage. Heat to the web may be applied by hot air, IR lamp, microwave or any other heat source that can heat the semi-crystalline regions of the polyethylene to relaxation.

Figure 6:
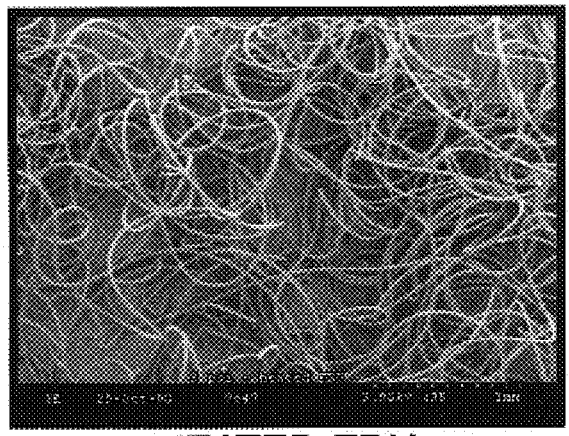
FIG. 6, is a photograph of fibers produced from a known hot FDU exhibiting a typical tight crimp.
Figure 7:
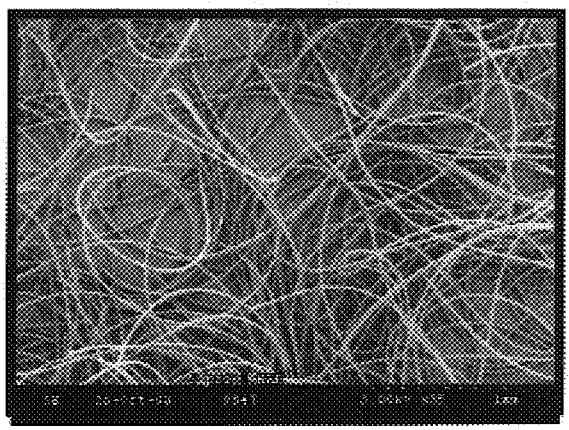
FIG. 7 is a photograph of fibers produced from an ambient non-heated FDU exhibiting a relaxed crimp.

Then the web passes through a cool zone that reduces the temperature of the polymer below its crystallization temperature. Since polyethylene is a semi-crystalline material, the polyethylene chains recrystallize upon cooling causing the polyethylene to shrink. This shrinkage induce a force on one side of the side-by-side fiber that allows it to crimp or coil if there are no other major forces restricting the fibers from moving freely in any direction. By using the cold FDU, the fibers are constructed so that they do not crimp in a tight helical fashion normal for fibers processed through a normal hot FDU. Instead, the fibers more loosely and randomly crimp, thereby imparting more z-direction loft to the fibers. Referencing FIG. 6, there are shown fibers produced from a normal hot FDU exhibiting a typically tight crimp. By comparison, FIG. 7 shows fibers produced from an ambient non-heated FDU exhibiting a much more relaxed macroscopic crimp conducive to a high loft web.

Factors that can affect the amount and type of crimp include the dwell time of the web under the heat of the first heating zone. Other factors affecting crimp can include material properties such as fiber denier, polymer type, cross sectional shape and basis weight. Restricting the fibers with either a vacuum, blowing air, or bonding will also affect the amount of crimp and thus the loft, or bulk, desired to be achieved in the high loft, low density webs of the present invention. Therefore, as the fibers enter the cooling zone, no vacuum is applied to hold the fibers to the forming wire 27 or second wire 35. Blowing air is likewise controlled or eliminated in the cooling zone to the extent practical or desired.

According to one aspect of the present invention, the fibers may be deposited on the forming wire with a high degree of MD orientation as controlled by the amount of under-wire vacuum, the FDU pressure, and the forming height from the FDU to the wire surface. A high degree of MD orientation may be used to induce very high loft into the web, as further explained below. Further, dependent upon certain fiber and processing parameters, the air jet of the FDU will exhibit a natural frequency which may aid in the producing of certain morphological characteristics such as shingling effects into the loft of the web.

According to the exemplary embodiment of FIG. 1, wherein the fibers 23 are heated by air flow in the first heating zone and passed by the forming wire 27 to the second wire 35, several crimping mechanisms are believed to take place to aid in the lofting of the fibers, including, without being bound by theory:

the below-wire exhaust will cool the web by drawing surrounding air through it which prevent bonding but restricts formation of loft, as the web is transferred out of the vacuum zone to the second wire, the vacuum force is removed and the unconstrained fibers are free to crimp, mechanically, MD surface layer shrinkage of a highly MD oriented surface layer may cause the surface fibers to buckle, mechanical shearing will be induced because the highly MD oriented surface shirring and bonds will leave subsurface fibers to continue shearing thereby creating loft by inducing shingling of the layers, a mechanical buckling pattern may be produced at the natural frequency of the FDU jet which will cause the heated fibers to loft in the same frequency, mechanical forces are created as fibers release from the forming wire 27 when leaving the vacuum area and then are briefly pulled back towards the vacuum unit 29, and a triboelectric (frictional) static charge is built up on the web and causes the fibers to repel each other allowing further loft within the web.

Figure 2:
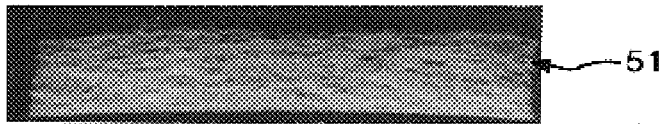
FIG. 2 is a photograph of a side view, or cross section along the machine direction axis, of a high loft, low density nonwoven web having z-direction components as formed with low machine direction orientation and through air bonding.

Referencing FIG. 2, there is seen a photograph of a side view, or cross section, along the machine direction axis, of a high loft, low density nonwoven web 51 having z-direction components formed of crimped fibers according to the present invention. The web is formed with low machine direction orientation deposition of fibers onto the forming web and through air bonding to set the web. The crimping forms a random, heterogeneous z-direction orientation of the fibers. As can be seen, the spaces between the fibers are also randomly distributed and produce irregularly spaced openings. The through air bonding, which involves drawing heated air through the web to fix the web in its high loft state, results in some collapse of the initial loft of the web. The loft of the web is approximately 0.25 inches.

Figure 3:
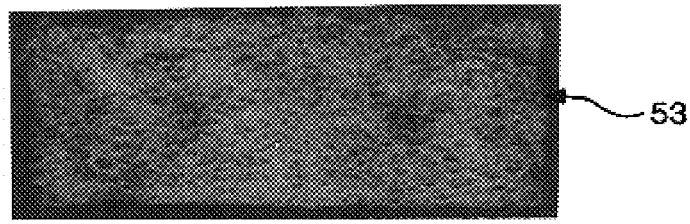
FIG. 3 is a photograph of a side view, or cross section along the machine direction axis, of a high loft, low density nonwoven web having z-direction components as formed with low machine direction orientation and static air bonding.

Referencing FIG. 3, there is seen a photograph of a side view, or cross section along the machine direction axis, of a very high loft, low density nonwoven web 53 having z-direction components formed of crimped fibers according to the present invention. The web is formed with low machine direction orientation deposition of fibers onto the forming web and static air bonding, where the web is undisturbed by drawn or blown air to set the web. The crimping forms a random, heterogeneous z-direction orientation of the fibers. As can be seen, the spaces between the fibers are also randomly distributed and produce irregularly spaced openings. The static air bonding, which does not involve drawing heated air through the web to fix the web in its high loft state, results in very little to no collapse of the initial loft of the web. The loft of the web is approximately 0.5625 inches.

Figure 4:
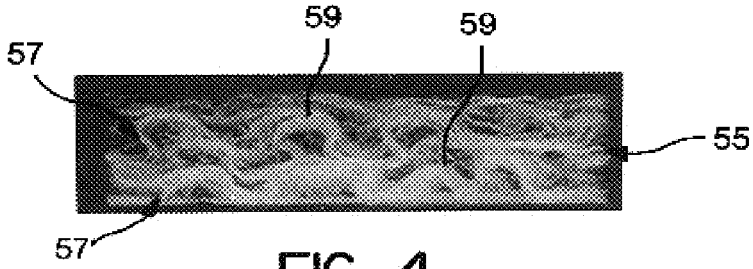
FIG. 4 is a photograph of a side view, or cross section along the machine direction axis, of a high loft, low density nonwoven web having z-direction components as formed with high machine direction orientation and through air bonding.

Referencing FIG. 4, there is seen a photograph of a side view, or cross section along the machine direction axis, of a high loft, low density nonwoven web 55 having z-direction components including shingled layers, collectively 57, exhibiting z-direction buckling, as at 59, at a frequency substantially similar to the natural frequency of the FDU jet and formed of crimped fibers according to the present invention. The shingling and buckling thereof are substantially irregular or random in nature but provide a higher loft and greater open space within the web. The web is formed with high machine direction orientation deposition of fibers onto the forming web and through air bonding. The crimping forms a random, heterogeneous z-direction orientation of the fibers. The through air bonding, which involves drawing heated air through the web to fix the web in its high loft state, results in some collapse of the initial loft of the web. The loft of the web is approximately 0.3125 inches.

Figure 5:
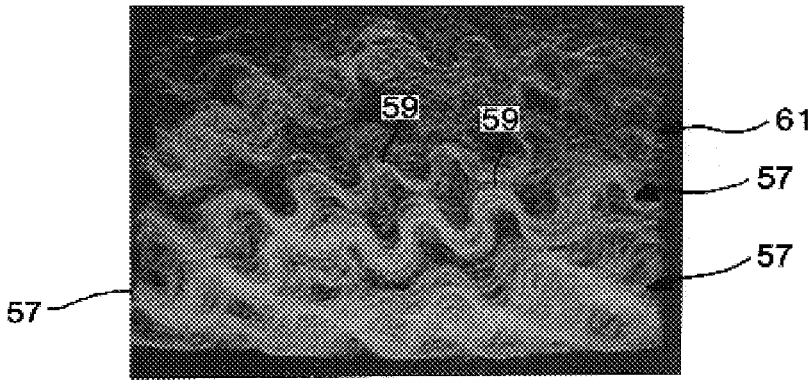
FIG. 5 is a photograph of a side view, or cross section along the machine direction axis, of a high loft, low density nonwoven web having z-direction components as formed with high machine direction orientation and static air bonding.

Referencing FIG. 5, there is seen a photograph of a side view, or cross section along the machine direction axis, of a very high loft, low density nonwoven web having z-direction components including shingled layers 57 with z-direction buckling 59 at a frequency substantially similar to the natural frequency of the FDU jet and formed of crimped fibers according to the present invention. The shingling and buckling thereof are substantially irregular or random in nature but provide a higher loft and greater open space within the web. The web is formed with high machine direction orientation deposition of fibers onto the forming web and static air bonding to fix the web in the initially crimped configuration. The crimping forms a random, heterogeneous z-direction orientation of the fibers. The static air bonding, which does not involve drawing heated air through the web to fix the web in its high loft state, results in little to no collapse of the initial loft of the web. The loft of the web is approximately 1.0 inches.

A high loft low density web was made with 4.5 denier PRISM fiber at about 0.14 inches loft, about 2.9 osy basis weight and 0.027 g/cc density, and tested for permeability, FIFE intake, flowback, filtration efficiency, and horizontal wicking. Results were generally superior in each category to a known high capillary bonded carded web at 2.9 osy basis weight, 0.12 inches loft, and 0.032 g/cc density. Efficiency of the web of the present invention, as measured in a penetration test on TSI equipment, generally tested at over 55 percent or less. Specifically the web of the present invention tested at 3500 darcies permeability, 6 seconds FIFE intake, and 14 grams flowback as opposed to 2500 darcies, 10 seconds, 20 grams, respectively, for the bonded carded web.

TEST METHODS AND MATERIALS

Basis Weight: A circular sample of 3 inches (7.6 cm) diameter is cut and weighed using a balance. Weight is recorded in grams. The weight is divided by the sample area. Five samples are measured and averaged.

Material caliper (thickness): The caliper of a material is a measure of thickness and is measured at 0.05 psi (3.5 g/cm$^2$) with a STARRET-type bulk tester, in units of millimeters. Samples are cut into 4 inch by 4 inch (10.2 cm by 10.2 cm) squares and five samples are tested and the results averaged.

Density: The density of the materials is calculated by dividing the weight per unit area of a sample in grams per square meter (gsm) by the material caliper in millimeters (mm). The caliper should be measured at 0.05 psi (3.5 g/cm$^2$) as mentioned above. The result is multiplied by 0.001 to convert the value to grams per cubic centimeter (g/cc). A total of five samples would be evaluated and averaged for the density values.

Permeability: Permeability is obtained from a measurement of the resistance by the material to the flow of liquid. A liquid of known viscosity is forced through the material of a given thickness at a constant flow rate and the resistance to flow, measured as a pressure drop is monitored. Darcy's Law is used to determine permeability as follows:

$$\text{Permeability}=[\text{flow rate}\times\text{thickness}\times\text{viscosity}/\text{pressure drop}] \quad \text{[Equation 1]}$$

where the units are:

permeability: cm$^2$ or Darcy1 Darcy=$9.87\times10^{-9}$ cm$^2$ flow rate: cm/sec viscosity: Pascal-sec pressure drop: Pascals The apparatus consists of an arrangement wherein a piston within a cylinder pushes liquid through the sample to be measured. The sample is clamped between two aluminum cylinders with the cylinders oriented vertically. Both cylinders have an outside diameter of 3.5 inches (8.9 cm), an inside diameter of 2.5 inches (6.35 cm) and a length of about 6 inches (15.2 cm). The 3 inch diameter web sample is held in place by its outer edges and hence is completely contained within the apparatus. The bottom cylinder has a piston that is capable of moving vertically within the cylinder at a constant velocity and is connected to a pressure transducer that is capable of monitoring the pressure encountered by a column of liquid supported by the piston. The transducer is positioned to travel with the piston such that there is no additional pressure measured until the liquid column contacts the sample and is pushed through it. At this point, the additional pressure measured is due to the resistance of the material to liquid flow through it. The piston is moved by a slide assembly that is driven by a stepper motor. The test starts by moving the piston at a constant velocity until the liquid is pushed through the sample. The piston is then halted and the baseline pressure is noted. This corrects for sample buoyancy effects. The movement is then resumed for a time adequate to measure the new pressure. The difference between the two pressures is the pressure due to the resistance of the material to liquid flow and is the pressure drop used in Equation (1). The velocity of the piston is the flow rate. Any liquid whose viscosity is known can be used, although a liquid that wets the material is preferred since this ensures that saturated flow is achieved. The measurements were carried out using a piston velocity of 20 cm/min, mineral oil (Peneteck Technical Mineral Oil manufactured by Penreco of Los Angeles, Calif.) of a viscosity of 6 centipoise.

Horizontal Wicking: This test measures how far liquid will move in a fabric when only one end of the fabric is immersed in the liquid and the fabric is horizontal. The fabric to be tested is prepared by cutting it into 1 inch (2.5 cm) by 8 inch (20.3 cm) strips in the machine direction. The sample is weighed and marked every 0.5 inch (13 mm) in the long dimension. The sample is placed on a 5 inch (12.7 cm) by 10 inch (25.4 cm) horizontal wire grid and slightly weighted so that it remains flat on the wire. A half inch of one end of the sample is submerged in a 0.5 inch deep by 0.5 inch wide by 5 inch long reservoir containing 10 ml of dyed 8.5 g/l saline solution. The end of the sample in the reservoir is held in place with a cylindrical glass stirring rod having a length of 1.5 inches (3.8 cm) and a diameter of 5/16 inches (7.9 mm) which also is submerged in the saline solution. The sample is allowed to rest with one end submerged in the reservoir for 20 minutes and is then carefully pulled horizontally out of the reservoir, cut at each 0.5 inch mark and each section weighed.

The dry sample weight is subtracted from the wet sample weight to arrive at fluid grams, and the 0.5 inch submerged in the reservoir is not considered. The total distance wicked is recorded along with the total grams of fluid wicked.

NaCl Efficiency: All filtration efficiency data are gathered from NaCl Efficiency testing. The NaCl Efficiency is a measure of the ability of a fabric or web to stop the passage of small particles through it. A higher efficiency is generally more desirable and indicates a greater ability to remove particles. NaCl efficiency is measured in percent according to the TSI Inc., Model 8130 Automated Filter Tester Operation Manual at a flow rate of 32 liters per minute using 0.1 micron (Fm) sized NaCl particles and is reported as an average of 3 sample readings. The testing manual is available from TSI Inc., Particle Instrument Division, 500 Cardigan Rd, Shoreview, Minn. 55126, or one may visit www.tsi.com. This test also can yield a pressure differential across a fabric using the same particle size and airflow rate.

The Fluid Intake and Flowback Evaluation (FIFE) is performed to determine the intake potential of the composites. The FIFE entails insulting the structure by pouring a defined amount of 0.9 percent saline solution into a cylindrical column resting vertically on top of the structure and recording the time it takes for the fluid to be taken in by the structure. The sample to be tested is placed on a flat surface and the FIFE testing apparatus placed on top of the sample. The FIFE testing apparatus consisted of a rectangular, 35.3 by 20.3 cm, plexiglass piece upon which was centered a cylinder with an inside diameter of 30 mm. The flat piece had a 38 mm hole corresponding with the cylinder so that fluid could pass through it from the cylinder to the sample. The cylinder was centered 2" from top or front of the absorbent pad in the crotch of diaper. The FIFE testing apparatus weighed 517 g.

Intake times are typically recorded in seconds. Samples were cut into 2.5 by 7 inch pledgets and were inserted into a STEP 4 HUGGIES ULTRATRIM™ commercially available diaper as a surge layer for the diaper. Samples were then insulted three times at 100 ml per insult with a wait of 15 minutes between the time the fluid was completely absorbed and the next insult.

After the third insult, the materials were placed on a vacuum box under 0.5 psi of pressure with a piece of blotter paper on top. The blotter paper was 110 lb. Verigood paper made by Fort James Corporation and was 3.5 by 12 inches (8.9 by 30.5 cm). The blotter paper was weighed before and after the test and the resulting differential reported as the flowback value as grams of fluid desorbed.

The high loft, low density webs according to the present invention are believed to provide excellent fluid handling characteristics such as may be desirable for filtration media, and fluid distribution or absorption layers of absorbent products and may further suitable for a variety of insulation type fabrics. The person having ordinary skill in the art will recognize that many characteristics of the web may be controlled to produce a variety of high loft, low density morphologies, including, but not limited to, fiber denier, deposition rates, heating and cooling rates, and the amount of forces applied to impede the crimping processes as set forth herein.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A method for producing a high loft, low density nonwoven web, the nonwoven web having x, y and z dimensions, with the x dimension being a machine direction, the y dimension being a cross machine direction and the z dimension being a loft direction, comprising:

a) forming a group of crimpable, substantially continuous, spunbond, bicomponent fibers of A/B morphology in an unheated FDU and depositing the group of fibers onto a forming wire;

b) first heating the fibers at a time and a temperature sufficient to induce a relaxation of molecular orientation of at least one component of the fiber wherein at most a small degree of nonfunctional bonding occurs between the fibers;

c) after said first heating, cooling the group of fibers below a crystallization temperature and thereby inducing the fibers to crimp;

d) minimizing the forces which tend to impede crimping of the fibers when performing steps b) and c) whereby the fibers are allowed to crimp in the z-direction; and e) reheating the group of fibers to cause the fibers to bond to each other to form a stable high loft, low density nonwoven web.

2. The method for producing a high loft, low density nonwoven web according to claim 1, wherein reheating the group of fibers occurs under heating or air flow conditions, or both, sufficient to maintain an original loft height of the group of fibers after steps b) and c).

3. The method for producing a high loft, low density nonwoven web according to claim 1, wherein the group of fibers is carried through the reheating zone at a velocity of greater than or equal to about 25 fpm.

4. The method for producing a high loft, low density nonwoven web according to claim 1, further comprising: applying a vacuum under the wire where the fibers are deposited on the forming wire.

5. The method for producing a high loft, low density nonwoven web according to claim 1, further comprising: removing or reducing blowing air during steps b) and c).

6. The method for producing a high loft, low density nonwoven web according to claim 1, further comprising: applying the fibers to the forming wire with a high degree of machine direction orientation.

7. The method for producing a high loft, low density nonwoven web according to claim 1, further comprising adding particulates to the group of fibers.

8. The method for producing a high loft, low density nonwoven web according to claim 1, further comprising producing a web with a basis weight of between about 0.3 osy and about 25 osy.

9. The method for producing a high loft, low density nonwoven web according to claim 1, further comprising producing a web with a density between about 0.002 g/cc and about 0.05 g/cc.

10. The method for producing a high loft, low density nonwoven web according to claim 1, further comprising producing a web with a loft between about 0.02 inches and about 1.50 inches.

11. The method for producing a high loft, low density nonwoven web according to claim 1, further comprising producing a web with a loft of about 0.03 to about 0.3 inches and a density of from about 0.022 g/cc to about 0.002 glcc.

12. The method for producing a high loft, low density nonwoven web according to claim 1, further comprising producing a web with a loft of about 0.1 inches to about 1.5 inches and a density of about 0.04 g/cc to about 0.003 glcc.

13. The method for producing a high loft, low density nonwoven web according to claim 1, further comprising producing a web wherein the fibers exhibit z-direction buckling at a substantially constant frequency.

14. The method for producing a high loft, low density nonwoven web according to claim 1, further comprising producing a web wherein the fibers comprise polypropylene and polyethylene polymers.

15. The method for producing a high loft, low density nonwoven web according to claim 1, further comprising producing a web wherein the fibers comprise cross sectional shapes selected from the group including Pentaloble, Tri-T, Hollow, Ribbon, X, Y, H, and asymmetric.

16. The method for producing a high loft, low density nonwoven web according to claim 1, further comprising producing a web wherein the fibers are integrally bonded to each other in the web.

17. The method for producing a high loft, low density nonwoven web according to claim 1, further comprising producing a web wherein the fibers are randomly crimped to produce a lofted material with heterogeneous fiber orientation, including substantially heterogeneous z-direction orientation and shingled layers of buckled Z-orientat ion zones to produce loft in the web.

18. The method for producing a high loft, low density nonwoven web according to claim 2, wherein the reheating heat is less than or equal to about 450 degrees F.

19. The method for producing a high loft, low density nonwoven web according to claim 2, wherein there is no induced air movement during the reheating.

20. The method for producing a high loft, low density nonwoven web according to claim 4, further comprising: removing or reducing the vacuum under the forming wire after the first heating.

21. A process for making a high loft low density nonwoven web of crimped filaments, the process comprising:

melting polyethylene polymer in an extruder;

melting polypropylene polymer in an extruder;

forming the polyethylene polymer and the polypropylene polymer into substantially continuous bicomponent fibers in a spinning apparatus;

traversing the bicomponent fibers through an unheated fiber draw unit;

depositing the bicomponent fibers to form a nonwoven web on a forming wire with the aid of below wire exhaust;

heating the nonwoven web with air having a temperature of about 110 degrees F. to about 260 degrees F. to relax a molecular orientation of at least one of the polymers wherein the bicomponent fibers are nonfunctionally bonded;

transferring the nonwoven web to a second wire and cooling to below a crystallization temperature of the polymers and thereby allowing the bicomponent fibers to freely form random crimped filaments, wherein the second wire does not have below wire exhaust;

setting the nonwoven web by reheating with air having a temperature of about 260 degrees F. to about 450 degrees F.

22. The process of claim 21, wherein the traversing through the fiber draw unit creates shingling of the bicomponent fibers by an air jet.

23. The process of claim 21, wherein the nonwoven web has a permeability of 3500 darcies.

24. The process of claim 21 wherein no bonding occurs between the fibers during the heating step.

* * * * *